US006419888B1

(12) United States Patent
Wyckoff

(10) Patent No.: US 6,419,888 B1
(45) Date of Patent: Jul. 16, 2002

(54) IN-SITU REMOVAL OF CARBON DIOXIDE FROM NATURAL GAS

(75) Inventor: Daniel Wyckoff, Durango, CO (US)

(73) Assignee: Softrock Geological Services, Inc., Durango, CO (US)

( * ) Notice: Subject to any disclaimer, the term of this patent is extended or adjusted under 35 U.S.C. 154(b) by 81 days.

(21) Appl. No.: 09/587,034

(22) Filed: Jun. 2, 2000

(51) Int. Cl.[7] ..... C10L 3/10

(52) U.S. Cl. ..... 423/220; 48/127.3; 48/127.5; 48/127.7; 585/800

(58) Field of Search ..... 48/127.3, 127.5, 48/127.7, 198.3, 198.7; 585/800; 423/220

(56) References Cited

U.S. PATENT DOCUMENTS

| | | | | |
|---|---|---|---|---|
| 3,284,161 A | | 11/1966 | Scott et al. | 23/212 |
| 3,690,550 A | * | 9/1972 | Hilberath et al. | 237/81 |
| 3,759,679 A | * | 9/1973 | Franz et al. | 48/213 |
| 4,372,386 A | | 2/1983 | Meeks et al. | 166/300 |
| 4,409,102 A | | 10/1983 | Tanner | 210/603 |
| 4,706,751 A | | 11/1987 | Gonduin | 166/272 |
| 4,741,745 A | | 5/1988 | Saotome et al. | 55/43 |
| 4,839,391 A | | 6/1989 | Range et al. | 518/712 |
| 4,871,468 A | | 10/1989 | Jeffrey | 252/190 |
| 5,052,482 A | | 10/1991 | Gonduin | 166/50 |
| 5,089,034 A | | 2/1992 | James, Jr. et al. | 55/28 |
| 5,411,721 A | | 5/1995 | Doshi et al. | 423/220 |
| 5,660,603 A | | 8/1997 | Chen et al. | 48/127.5 |
| 5,938,819 A | | 8/1999 | Seery | 95/104 |

OTHER PUBLICATIONS

Olsen "Unit Processes and Principles of Chemical Engineering" New York, D. Van Nostrand Co., Inc., pp. 1–3, date stamped Jul. 5, 1932.*

Mori et al. "Pre–Combustion Removal of Carbon Dioxide . . . " J. of Energy Res. Tech., vol. 114, Sep. 1992, pp. 221–226.*

C. George Segeler (ed.) Fuel Flue Gases: The Application and Interpretation of Gas Analyses and Tests, Copyright 1940 by the American Gas Association, U.S.A., p. 20.*

Callahan, M. *Proceedings of the 26th Power Sources Symposium*, PSC Publishers; Red Bank, NJ 1974, p. 181.

Parmon, V. et al. *Proceedings of the 11th World Hydrogen Energy Conference*, Stuttgart; Schon & Wetzel GmbH; Frankfurt am Main, 1996; pp. 2439–2448.

Muradov, N.Z. *Proceedings of the 11th World Hydrogen Energy Conference*, Stuttgart; Schon & Wetzel GmbH; Frankfurt am Main, 1996; pp. 697–702.

Muradov, N.Z. *Energy & Fuels*, 1998, vol. 12, No. 1, pp. 41–48.

Blumen and Migerwa, *Fuel Cell Systems*, Plenum Press, New York, 1993.

(List continued on next page.)

*Primary Examiner*—Steven P. Griffin
*Assistant Examiner*—Timothy C Vanoy
(74) *Attorney, Agent, or Firm*—Fulbright & Jaworski L.L.P.

(57) ABSTRACT

A process is provided for the in-situ removal of carbon dioxide out of natural gas by diverting a stream of the natural gas to a hydrocarbon reformation unit, which converts this diverted stream of the natural gas into a hydrogen-containing gas, and feeding this hydrogen-containing gas and the (undiverted) natural gas into a methanation unit, where the hydrogen reacts with carbon dioxide to form methane, thereby decreasing the amount of carbon dioxide in the natural gas. A second steam of the natural gas may be diverted from the natural gas and combusted, thereby generating heat which may be used for catalyst regeneration and/or for providing any heat necessary for the reactions occurring in the methanation unit or the hydrocarbon reformation unit.

3 Claims, 3 Drawing Sheets

OTHER PUBLICATIONS

Blok et al., *Energy*, vol. 22, No. 2/3, pp. 161–168 (1997).
Andus et al., *Proceedings of the 11th World Hydrogen Energy Conference*, Stuttgart; Schon & Wetzel GmbH: Frankfurt am Main, 1996; pp. 525–534.
Srinivasan, S., et al. Chapter 2, pp. 37–43 from *Fuel Cell Systems*, Plenum Press, New York, 1993, Blomen and Mugerwa, Eds.
Barendrecht, E. Chapter 3, pp. 73–119 from *Fuel Cell Systems*, Plenum Press, New York, 1993, Blomen and Mugerwa, Eds.
Pietrogrande, P., et al. Chapter 4, pp. 121–157 from *Fuel Cell Systems*, Plenum Press, New York, 1993, Blomen and Mugerwa, Eds.

* cited by examiner

IN-SITU REMOVAL OF CARBON DIOXIDE FROM NATURAL GAS

BACKGROUND OF THE INVENTION

1. Field of the Invention

The invention pertains to a method and an apparatus for the improvement in the quality of well-head natural gas and in the prevention of pipeline corrosion in natural gas transport through the removal carbon dioxide ($CO_2$) naturally occurring in the gas.

2. Brief Description of the Problem and the Prior Art

The term natural gas refers to mixtures of inert and light hydrocarbon components as well as non-hydrocarbon components which are recovered from natural gas wells or from gas coproduced in the production of oil. The removal of $CO_2$ as well as other gaseous impurities has been the subject of much work in the past. The overwhelming majority of this work is directed toward the separation of $CO_2$ from natural gas as opposed to its conversion to a different molecular species. These separations are typically performed through absorption or adsorption methodologies or alternatively through chemical scrubbing using techniques such as chemical chelation. The disadvantage of these current techniques lies mainly in their cumbersome characteristics which require replenishment of consumable chemical absorbents, adsorbents, or complexing agents. This renders these techniques less than optimal for remote application at a well-head.

The presence of $CO_2$ and water is well known to play a role in the corrosion of pipelines. Corrosion of natural gas pipelines raises costs by both necessitating the replacement of pipelines and by the concomitant production loss during the resulting downtime. $CO_2$ in the presence of water is in equilibrium with carbonic acid, bicarbonate, and carbonate ions. The pH-modifying nature of these species renders them corrosive to the pipelines used in natural gas transport. The chemistry is represented below:

$$CO_2+H_2O \leftrightarrows H_2CO_3$$

$$H_2CO_3 \leftrightarrows HCO_3^- + H^+$$

$$HCO_3^- \leftrightarrows CO_3^{-2} + H^+$$

The problem can be alleviated by the removal of water, $CO_2$, or both. One way to remove water is to lower the water dew point below the pipeline temperature. Temperature control through the expected distances of a natural gas pipeline is likely to be logistically difficult and cost prohibitive. Water may also be remove by various adsorption and absorption techniques that can be applied to $CO_2$. Again, the regeneration or replacement of consumable chemical adsorbents and absorbents is a disadvantage of this method. Traditional natural gas purification by $CO_2$ removal alone has also been based on adsorption and absorption.

An object of the present invention is a chemical process that is a self contained with respect to the replenishment of chemical reactants and heat, and which converts carbon dioxide in well-head natural gas to methane prior to pipeline shipment to non-remote locations. The primary goal of the present invention is the prevention of corrosion to transmission pipelines of natural gas through the removal of carbon dioxide, while a further object of the present invention is an environmentally friendly mechanism to remove $CO_2$ from natural gas without venting to the atmosphere. Additionally, the present invention is useful for the improvement in quality of a natural gas effluent from a well-head prior to transmission to other locations.

U.S. Pat. No. 5,938,819 describes the bulk separation of carbon dioxide from methane using natural clinoptilolite. This is a zeolite-type chemical species whose mode of action is inclusion complexation, a non-covalent form of binding which is generally reversible under mild conditions. Purification of the gas stream is achieved through selective inclusion complexation. These types of adsorption systems are characterized by the need to regenerate the adsorbent species. In the '819 patent, this is achieved through a technique commonly known as pressure swing adsorption (PSA). The system requires a supply of dry air for regeneration of the $CO_2$ adsorbate. The requirement that reactants and/or adsorbents must be replenished or regenerated with an external supply of dry air detracts from the ease of remote application of the process at the well-head.

U.S. Pat. No. 5,411,721 describes the removal of $CO_2$ from natural gas through a combination system utilizing membrane permeability selective techniques as well as pressure swing adsorption. Separation systems based on membrane permeability typically require high pressures, while those that rely on pressure swing adsorption are relatively inefficient at higher pressures. The '721 patent combines the two techniques in such a way that the permeate feedstream is fed to the PSA system after passing the membrane. This nicely takes advantage of the pressure drop across the membrane in a a two step system is employed which minimizes pressure constraints and results in high purity, but has the disadvantage of a relatively high degree of complexity. The more complex a system of purification is, the less amenable it is to remote application at the well-head. The systems amenable to remote applications are ideally less cumbersome.

U.S. Pat. No. 5,089,034 uses multiple stage temperature swing adsorption (TSA) to purify natural gas by stepwise removal of $H_2O$ and $CO_2$. By first removing water, the gas stream can later be treated at a lower temperature in the second adsorption zone for more efficient and less expensive carbon dioxide removal. This is based upon different chemistry and is of greater complexity than the present invention which makes the system less desirable for remote applications.

Still other systems separate impurities from natural gas streams through techniques of countercurrent chromatography. This technique is essentially a liquid-gas extraction. U.S. Pat. No. 5,660,603 uses an aqueous liquid, ideally seawater, as the liquid extraction medium. By using seawater at selected temperatures and pressures, hydrates of $CO_2$ or other light hydrocarbons are formed. The liquid extraction medium is regenerated by the release of the complexed impurity gases by variations in temperature or pressure. It differs from the present invention in having the obvious disadvantages of requiring externally supplied heat and pressure. This results in a complex operation again not optimally suited for remote application at the well-head. Rather it is better suited for downstream use at a gas processing facility prior to distribution to gas customers.

Other and further chemistries are employed to selectively remove gaseous impurities from natural gas streams. U.S. Pat. No. 4,871,468 describes a method of removing hydrogen sulfide and carbon dioxide using a mixture of a polyvalent metal chelate in a carbon dioxide selective absorbent solvent at varying values of pH. Replenishment of solvents and reagents necessary to control pH are disadvantages here. The overall process involves reasonably complex solution chemistry it is better suited for a processing facility than a remote location such as well-head.

Numerous other patents exist that are variations on the same themes. Unlike the present invention, they variously employ complexation chemistry or selective adsorption and/or absorption as the separatory step. U.S. Pat. No. 4,741,745 employs a liquid-gas extraction technique where a liquid adsorbent is judiciously chosen. U.S. Pat. No. 4,409,102 combines a liquid-gas adsorption in a countercurrent extraction mode with a chemical scrubbing step.

All of this prior art differs fundamentally from the present invention in the chemistries employed. None of them are based on the removal of $CO_2$ through its conversion to methane, and all are characterized by the need to regularly replenish reagents or require an external supply of heat and/or pressure.

SUMMARY OF THE INVENTION

In the preferred embodiment, a method and processor is used to purify a natural gas stream by removal of carbon dioxide through a methanation reaction which converts the carbon dioxide to methane by using molecular hydrogen obtained by chemical means from a portion of the natural gas stream to be purified. The system therefore consists of two reaction chemistries.

In one embodiment, a side stream of the main natural gas stream is diverted to a combustion device to generate heat that may be used to drive one or both of the chemical reactions. Such heat is also used to internally regenerate catalyst. The transfer of heat from the combustion device to one or both of the reactions may be regulated by ordinary means.

In the preferred embodiment, the methanation reaction is catalytic. In this embodiment, the catalyst interface may be configured in any number of conventional ways. Typically, this takes the form of columns or beds. Non-conventional forms may be used as well. One example of the methanation reaction is that commonly used in analytical gas chromatographic applications for the detection of carbon dioxide. This involves the use of a nickel-based catalyst and a temperature of 380° C.

The hydrogen separator reaction chamber consists of a hydrocarbon reformation reactor in the preferred embodiment. Preferred chemistries are those commonly used in hydrocarbon reformation chemistry, particularly fuel cell technology. These typically use nickel, platinum, or palladium based catalyst.

The process involves redirection of side streams of raw natural gas to the hydrogen separator reaction chamber where the molecular hydrogen is extracted for subsequent use in combination with the main natural gas stream in the methanation reaction chamber. Upon methanation of the carbon dioxide in the raw natural gas stream, a purified stream emerges which is less concentrated in carbon dioxide than is the raw stream.

Further objects of the present invention utilize analogous chemistries substituted for the methanation reaction chemistry and/or for the hydrogen separator reaction. They involve the extraction of hydrogen from the main gas stream and the subsequent use of the extracted hydrogen to convert carbon dioxide to methane.

Other and further objects, features, and advantages would be apparent and eventually more readily understood upon a reading of the specification and by reference to the accompanying drawings forming a part thereof, and the examples given therein of the presently preferred embodiments of the invention.

DETAILED DESCRIPTION OF THE PREFERRED EMBODIMENTS

It is readily apparent to one skilled in the art that various embodiments and modifications may be made to the invention disclosed in this application without departing from the scope and spirit of the invention.

As used herein a "conduit" means any means for transferring gaseous material. Examples are a pipe or hose.

As used herein the term "hydrocarbon reformation" refers to the chemical conversion of hydrocarbons to solid carbon or to oxides of carbon and gaseous hydrogen.

As used herein the term "hydrogen separator reaction chamber" refers to the reaction chamber where the hydrocarbon reformation occurs.

As used herein the term "methanation reaction chamber" refers to the reaction chamber wherein carbon dioxide is converted to methane.

Figure 1:
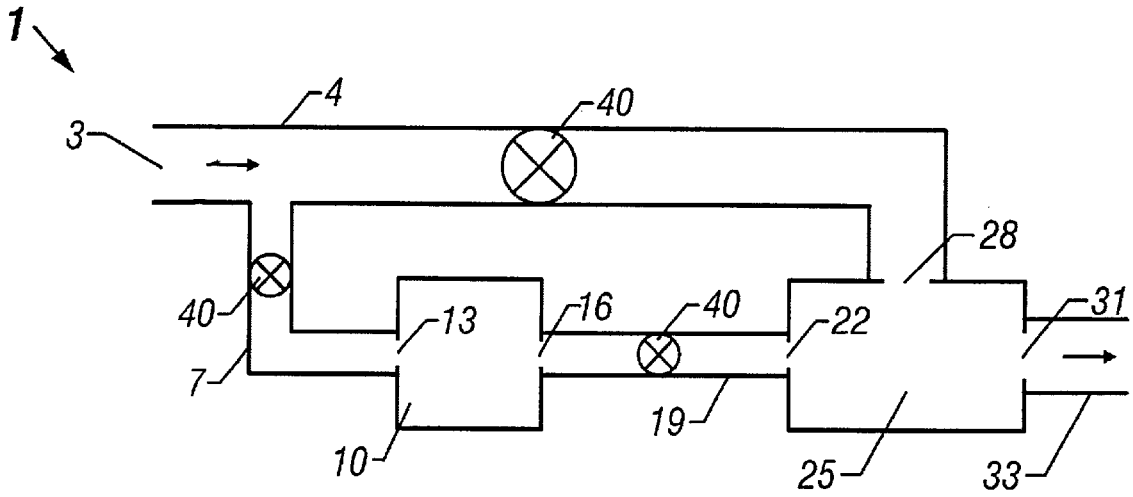
FIG. 1 illustrates a schematic of the core of the processor in block diagram demonstrating how the main stream of raw natural gas is cleansed of carbon dioxide in a self-contained process.

One embodiment of the present invention is seen in FIG. 1 and includes an apparatus 1 for in-situ removal of $CO_2$ from natural gas streams at the well-head by the chemical conversion of $CO_2$ to methane. The exit port of the well-head 3 is connected to one end of main conduit 4 and the other end of main conduit 4 is connected to inlet port 28 of the methanation reaction chamber 25 within apparatus 1. As the natural gas exits the well-head, it flows through main conduit 4 into apparatus 1. One end of side stream conduit 7 is tapped into the main conduit 4 for the diversion of a first small stream of natural gas, and the other end of side stream conduit 7 is connected to the hydrogen separator reaction chamber 10 through inlet port 13. The natural gas flowing through side stream conduit 7 enters the hydrogen separator reaction chamber 10, and is chemically converted to hydrogen and solid carbon or to oxides of carbon and hydrogen. The hydrogen flows from the hydrogen separator reaction chamber 10 through the outlet port 16 into one end of the conduit 19 connected to said outlet port 16. The other end of the said conduit 19 is connected to the inlet port 22 of the methanation reaction chamber 25 where it combines with the natural gas flowing into the methanation reaction chamber 25 through inlet port 28 from the main pipe 4. The methanation reaction chamber 25 combines the hydrogen gas from the methanation reaction chamber 25, and the $CO_2$ in the natural gas in the presence of a catalyst to convert the hydrogen gas and $CO_2$ to $CH_4$. The resulting $CH_4$ is mixed with the natural gas and this mixture flows through outlet port 31 which is connected to conduit 33 for further delivery of lower-$CO_2$ natural gas to the user.

One skilled in the art recognizes that the natural gas could be delivered to a storage facility or other facility prior to delivery to the methanation reaction chamber. Further, the lower $CO_2$ wellhead gas can be delivered to a storage facility or other facility prior to distribution.

Figure 2:
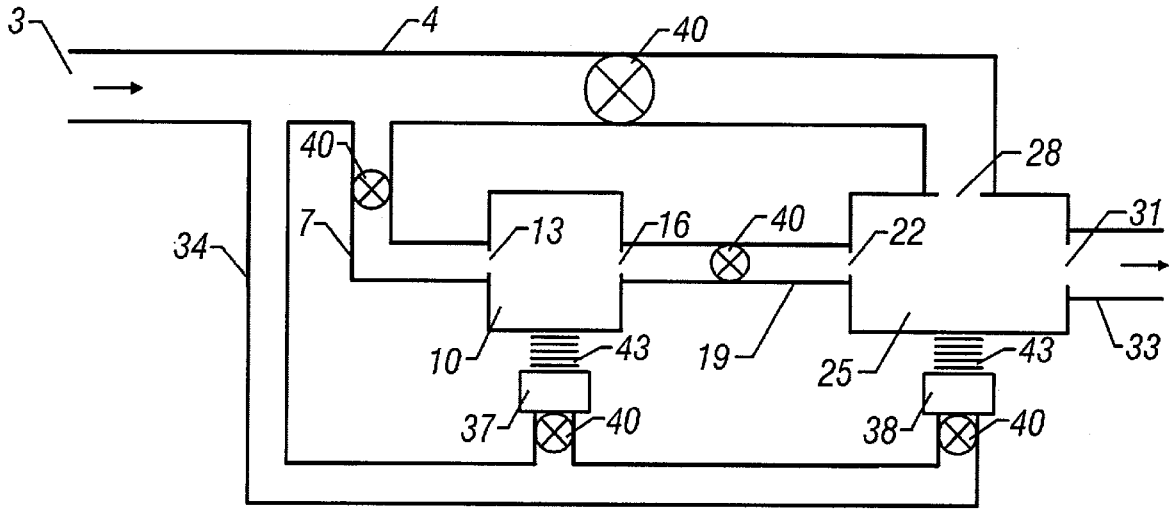
FIG. 2 illustrates a schematic of the processor in block diagram including heat generating elements.

In another specific embodiment, the apparatus can be modified as shown in FIG. 2. In this embodiment, the end of a second side stream conduit 34 is tapped into the main conduit 4 for diversion of a second small stream of natural gas into combustion devices 37 and 38. Although FIG. 2 shows separate combustion devices 37 and 38, one skilled in the art recognizes that one combustion device could be used. The single combustion device could be used to heat both the hydrogen separator reaction chamber 10 and the methanation reaction chamber 25. Alternatively, only one of the hydrogen separator reaction chamber 10 or methanation reaction chamber 25 is heated. Reference number 43 represents the thermal contact-between respective combustion device and the chamber to be heated.

Although the inlet port 22 on the methanation reaction chamber 25 for the connecting conduit 19 and the inlet port 28 on the methanation reaction chamber 25 are depicted as separate ports on FIG. 1, one skilled in the art recognizes they can be single ports in which both conduits 19 and 4 attach on conduit 19 and feed into conduit 4 at a location upstream to conduit 4's attachment to inlet port 28.

In specific embodiments, any or all of the main conduit 4, first side stream conduit 7, second side stream conduit 34, connecting conduit 19 and pipeline 33 can have flow regulators 40 attached to regulate the flow of gas in the pipes.

In a specific method of the present invention, the fraction of the well-head gas which flows through first side stream conduit 7 is usually less than 5% of the overall volume of well-head gas flowing through main conduit 4 but may be more depending upon the relative $CO_2$ content of the well-head gas.

Figure 3:
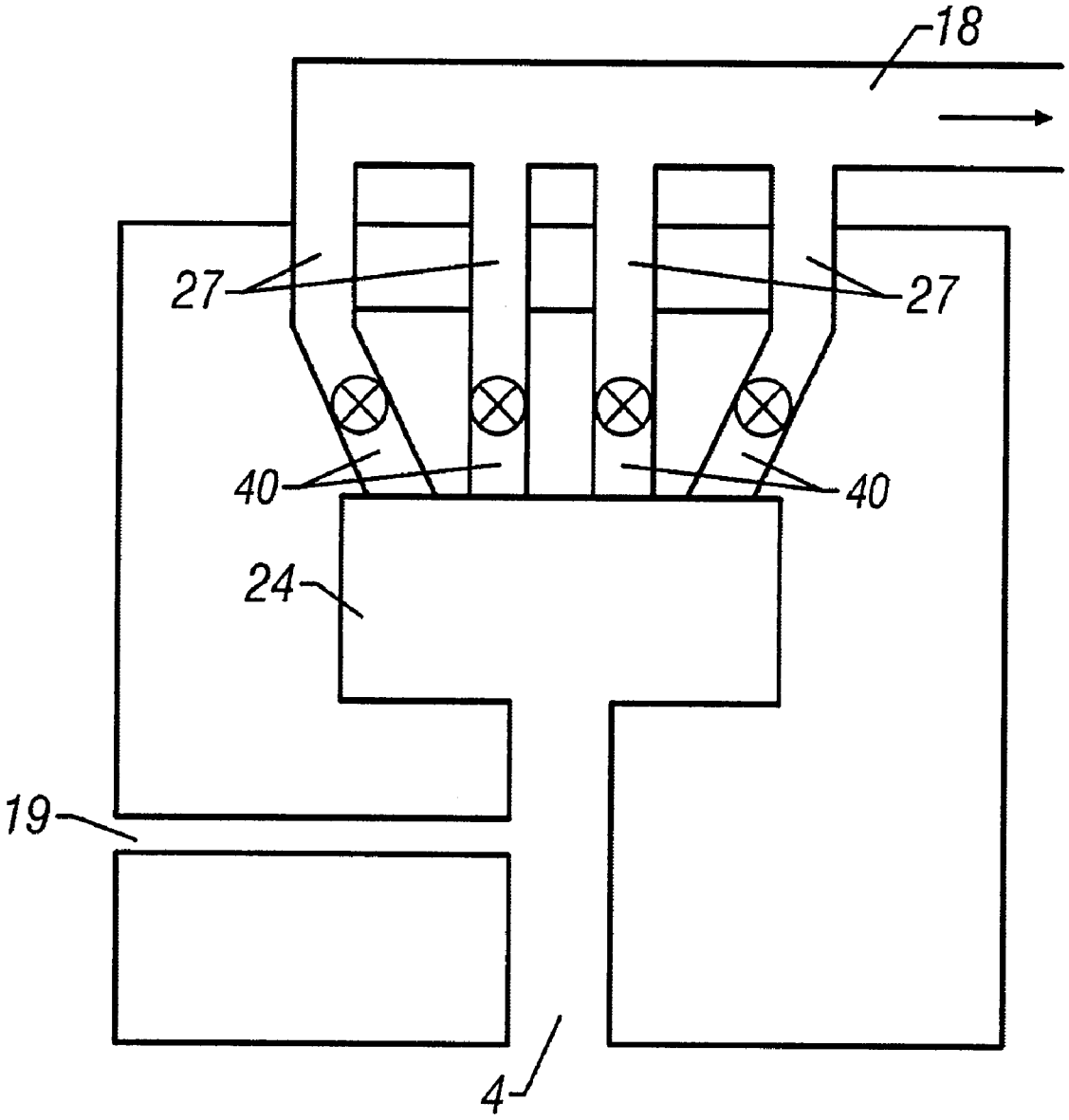
FIG. 3 is a schematic of the multiple column mode of the methanation reaction.

The catalytic reaction of the preferred embodiment may also be configured in any number of ways so as to maximize surface contact area between the gaseous reactants and the catalyst. A specific embodiment includes a scaled-up version of methanation as it is performed in analytical gas chromatographic applications. Solid catalyst of good porosity in the form of small pellets or powder are immobilized in a column. The column may be stainless steel or any other material having good strength and preferably little tendency to corrode. While the simplest column configuration would consist of a single column, alternatively, a multi-column configuration could be employed, as depicted in FIG. 3. The incoming feedstream of hydrogen of conduit 19 and well-head gas from main conduit 4, upon mixing, could be split by a manifold 24 into multiple parallel columns 27 with pressure or flow regulation 40. The multi-column mode is particularly useful where regeneration of catalyst using a regeneration cycle is envisioned. Such regeneration is further discussed below. The purified effluent streams are recombined as output 18. The column or columns are housed in the reaction chamber which is heated to the reaction operating temperature, typically 380° C. Prior to entering the column or manifold, the stream is mixed with the gaseous effluent from the hydrocarbon reformation reaction chamber. It is preferable to incorporate a form of pressure regulation for the incoming hydrocarbon reformation effluent to regulate the partial pressure of hydrogen from the incoming gaseous mixture to optimize the methanation reaction. This can be achieved by considering such variables as 1) flow or pressure of the incoming main gas stream, 2) relative-$CO_2$ content of the incoming gas stream, 3) the nature of the catalytic reaction chemistry employed. The relative $CO_2$-content of the incoming gas stream is a characteristic of the gas being recovered and this measurement may be performed remotely or directly at the well-head. It is envisioned that a computer-controlled feedback loop analytical system may be employed which continuously varies the pressure of the incoming hydrocarbon reformation effluent in real time to keep the methanation reaction optimized.

It should be noted that there are numerous variations to the aforementioned methanation reaction chemistry and the present invention envisions the use of any catalytic system useful for methanation that is appropriate given the level of carbon dioxide removal that is desired. In the preferred embodiment, the methanation reaction chamber consists of a scale-up of a gas chromatographic apparatus utilizing methanation chemistry for the enhanced detection of carbon dioxide.

In a preferred embodiment, the use of multiple layers or stages of of catalytic beds may be employed. In this configuration, the natural gas effluent emerging from the well-head is passed over the multiple catalytic beds or stages at the temperatures, pressures, and flow rates optimized to the nature of the catalytic reaction employed and the physical characteristics of the catalyst such as surface area, porosity, etc.

The invention herein disclosed does not involve a separation step in the main natural gas stream wherein a low level, undesirable gaseous impurity is separated. Rather, the removal of $CO_2$ is effected by the catalytic conversion of it to methane, $CH_4$. The catalyst is neither produced not consumed in a catalytic chemical reaction. The remaining chemical reactants, apart from the catalyst, are inherently present in the system itself. The hydrogen used to perform the conversion is obtained from the hydrocarbon reformation of the methane in the natural gas stream. Heat required for the reaction is obtained by burning a small side stream of the natural gas effluent. The methane product is a major component of natural gas; the substitution of it for carbon dioxide represents an enhancement in the quality of the natural gas stream.

By decreasing the $CO_2$ content of the natural gas stream at or near the well-head, transmission pipeline corrosion is minimized. Concerns regarding the venting of $CO_2$ to the atmosphere from an environmental standpoint may be obviated because the invention involves the conversion of $CO_2$ to a useful molecular species and not merely its separation. The present invention is amenable to the elimination of disposal problems and thereby addresses environmental concerns. As carbon dioxide is merely being separated by prior methods, disposal would still be an issue. Typically, this disposal is simply venting to the atmosphere. For environmental reasons, this disposal method is becoming increasingly unacceptable. $CO_2$ is a known greenhouse gas which is suspected to cause global warming. Various international agreements has mandated reductions in the atmospheric release of the gas over scheduled periods. Thus the removal of the gas from the natural gas stream has environmental benefits in addition to the economic advantages that should accrue from the improvement in pipeline transmission efficiencies.

From the standpoint of logistics and feasibility, the improvement lies in the relatively self contained nature of the process, its novel combination of known and proven chemistries, its relative simplicity, and the resulting amenability to application at remote locations; in particular, at the well-head. It affords improvements in the pipeline transport of natural gas streams by purification at the well-head or immediately after its emergence from the well-head.

A standard methanation reaction is to be used for carbon dioxide removal. Presently, such reactions are used on an analytical scale in the gas chromatographic analysis of $CO_2$. By converting $CO_2$ to $CH_4$ prior to flame ionization detection in a gas chromatograph, analytical sensitivity is greatly enhanced and much lower limits of detection may be achieved. The preferred embodiment of the present invention lies, in part, on a scale-up of this analytical conversion.

Methanation has also been applied on a larger scale in the petroleum industry in the past. The chemistry is treated in detail in U.S. Pat. Nos. 5,052,482, 4,706,751, 4,372,386, and 4,893,391, among others. These patents use the methanation process for its heat releasing properties. Unlike the present invention, the conversion of $CO_2$ or CO to $CH_4$ in the aforementioned references is incidental. The exothermic reaction releases heat which is then used to vaporize water. The heat generated steam was the desired product in those technologies. The technique of steam injection downhole into a well to lower the viscosity of heavy oil and thereby enhance recovery has been in use for a number of years. Prior to the use of the methanation process to produce high quality steam, the "huff and puff" method was used to inject steam down a well hole to enhance oil recovery. This had a number of disadvantages, the primary disadvantage being the loss of heat during transport down the well hole. Thus a system was desired which would yield high quality steam at the point of use or as close to the point of use as possible to minimize heat losses. As a result, the methanation step was applied downhole. The heat released inside the well would be used to heat water and create steam which was then used to enhance heavy oil recovery. The patents using methanation reactions for petroleum recovery differ additionally from the present invention in that they use an externally supplied Syngas feed to supply the required hydrogen ($H_2$) for the methanation reaction. The present invention uses the natural gas stream itself as its hydrogen source, obviating the need for an external supply of hydrogen. This attribute partially accounts for the self-contained nature of the present apparatus and process.

Known hydrocarbon reformation reactions are employed to produce hydrogen used for methanation. These reactions may be divided into $CO_2$-forming and non-$CO_2$-forming reactions. The non-$CO_2$-forming reactions are well-known processes, and are commonly termed "thermal decomposition" when applied to natural gas. U.S. Pat. No. 3,284,161 describes the use of alumina, silica-alumina, among others, to convert gaseous hydrocarbons to carbon and gaseous hydrogen. Other references have exploited the higher catalytic activities of metal-based catalysts such as cobalt, chromium, copper, nickel, iron, platinum, palladium, and ruthenium. See Callahan, M. *Proceedings of 26th Power Sources Symposium,* PSC Publishers; Red Bank, N.J., 1974, p. 181; and Parmon, V.; Kuvshinov, G.; Sobyanian, V. *Proceedings of the 11th World Hydrogen Energy Conference,* Stuttgart; Schon & Wetzel GmbH; Frankfurt am Main, 1996; pp. 2439–2448. These typically take the form of metal-oxides. The temperature-dependant activities of various metal and metal-oxide thermal decomposition catalysts have been studied. See Muradov, N. Z.; *Proceedings of the 11th World Hydrogen Energy Conference,* Stuttgart; Schon & Wetzel GmbH; Frankfurt am Main, 1996; pp. 697–702. Recently, results for carbon-based catalysis and metal-based catalysis have been compared. See Muradov, N. Z. *Energy & Fuels,* 1998, 12, 41–48. The buildup of carbon on the surface of the metal-based catalysts resulted in the eventual poisoning of the catalyst. This is reversed by the burn-off of carbon to carbon dioxide. In the case of carbon-based catalysts, a fluidized bed reactor for the continuous removal of carbon from the catalytic surface is employed to remove carbon byproduct which is less tightly bound to the catalyst in such cases. Basic hydrocarbon reformation chemistry is well-known in the art and is described in detail in many literature sources in the field. See, e.g., Fuel Cell Systems, edited by Leo M. J. Blomen and Michael Mugerwa, Plenum Press, New York, 1993. The catalyst system may also be a combination of different individual catalyst species.

In the present invention, either catalytic system is employed for hydrogen generation. In cases where the accumulation of solid carbon by-product necessitates regeneration of catalyst, multi-column or multi-bed catalysts arrangement are used in conjunction with a multi-stage process. In one stage (the catalytic stage), one or more columns or beds are used in the catalytic reaction to remove $CO_2$. When regeneration is required, a regeneration stage (typically a burn-off cycle) is applied to these previously used columns or beds. The flow of raw natural gas is redirected to a series of new or previously regenerated columns or beds such that the overall process may proceed unabated, if desired. During this regeneration stage, the original columns or beds are regenerated with a burn off cycle which effectively removes the carbon product by conversion to oxides of carbon by the application of heat. These oxides of carbon are directed away from the natural gas stream and may be sequestered or otherwise disposed of. In the case of carbon-based catalyst, mechanical or chemical methods are employed in lieu of the burn out method to removed the less tightly bound carbon byproduct.

Alternatively, $CO_2$-producing methods of hydrocarbon reformation are employed, but this requires employing techniques of $CO_2$ sequestration to avoid $CO_2$ introduction into the downstream methanation process. Techniques such as those applied in fuel cell applications to output only the desired hydrogen while sequestering the carbonaceous by-product are equally applicable here. See, e.g., *Fuel Cell Systems,* Leo M. J. Blomen and Michael Mugerwa, Eds., Plenum Press, New York, 1993; Blok, K.; Williams, R. Katofsky, R., Hendriks, C. *Energy,* 1997, 22, pp. 161–168: Andus, H.; Kaarstad, O.; Kowal, M.; *Proceedings of the 11th World Hydrogen Energy Conference,* Stuttgart; Schon & Wetzel GmbH; Frankfurt am Main, 1996; pp. 525–534.

In the preferred embodiment of the methanation reaction, the raw stream of natural gas is combined with hydrogen from the reformation reaction and passed over a catalytic bed typically consisting of a catalyst and solid support of high surface area. As discussed, large scale methanation is currently used in oil recovery technology where the by-product of heat is used to produce steam which is used downhole to enhance oil recovery. As is the case in oil recovery applications, improvements in methanation chemistry, be they catalytic or non-catalytic, would enjoy application in the present apparatus and process.

The catalytic reaction of the preferred embodiment may also be configured in any number of ways so as to maximize surface contact area between the gaseous reactants and the catalyst. A specific configuration is one which is a scaled-up version of methanation as it is performed in analytical gas chromatographic applications. Solid catalyst of good porosity in the form of small pellets or powder are immobilized in a column. The column may be stainless steel or any other material having good strength and preferably little tendency to corrode.

REFERENCES

All patents and publications mentioned in the specification are indicative of the level of those skilled in the art to which the invention pertains. All patents and publications are herein incorporated by reference to the same extent as if each individual publication was specifically and individually indicated to be incorporated by reference.

U.S. Patent Documents

| | | |
|---|---|---|
| 5,938,819 | 6/1988 | Seery |
| 5,411,721 | 5/1995 | Doshi et al. |
| 5,089,034 | 2/1992 | James, Jr. et al. |
| 5,660,603 | 8/1997 | Chen et al. |
| 4,871,468 | 10/1989 | Jeffrey |
| 4,741,745 | 3/1988 | Saotome et al. |
| 4,409,102 | 10/1983 | Tanner |
| 5,052,482 | 10/1991 | Gonduin |
| 4,706,751 | 11/1987 | Gonduin |
| 4,372,386 | 2/1983 | Meeks et al. |
| 4,839,391 | 6/1989 | Range et al. |
| 3,284,161 | 11/1966 | Scott et al. |

Other Publications (1) Callahan, M. *Proceedings of* 26$^{th}$ *Power Sources Symposium,* PSC Publishers; Red Bank, N.J., 1974, p. 181.

(2) Parmon, V.; Kuvshinov, G.; Sobyanian, V. *Proceedings of the* 11$^{th}$ *World Hydrogen Energy Conference,* Stuttgart; Schon & Wetzel GmbH; Frankfurt am Main, 1996; pp. 2439–2448.

(3) Muradov, N. Z.; *Proceedings of the* 11$^{th}$ *World Hydrogen Energy Conference,* Stuttgart; Schon & Wetzel GmbH; Frankfurt am Main, 1996; pp. 697–702.

(4) Muradov, N. Z. *Energy & Fuels,* 1998, 12, 41–48.

(5) See, e.g., *Fuel Cell Systems,* edited by Leo M. J. Blumen and Michael Mugerwa, Plenum Press, New York, 1993.

(6) Blok, K.; Williams, R. Katofsky, R., Hendriks, C. *Energy,* 1997, 22, pp. 161–168.

(7) Andus, H.; Kaarstad, O.; Kowal, M.; *Proceedings of the* 11$^{th}$ *World Hydrogen Energy Conference,* Stuttgart; Schon & Wetzel GmbH; Frankfurt am Main, 1996; pp. 525–534.

One skilled in the art readily appreciates that the present invention is well adapted to carry out the objectives and obtain the ends and advantages mentioned as well as those inherent therein. Systems, methods, procedures and techniques described herein are presently representative of the preferred embodiments and are intended to be exemplary and are not intended as limitations of the scope. Changes therein and other uses will occur to those skilled in the art which are encompassed within the spirit of the invention or defined by the scope of the pending claims.

What is claimed is:

1. A process for the removal of carbon dioxide from a natural gas stream, comprising the steps of:

diverting a first side stream of natural gas from the natural gas stream into a catalytic hydrogen separator reaction chamber where the diverted first side stream of natural gas is converted into a gas comprising hydrogen; and, feeding the gas comprising hydrogen and the remainder of the natural gas stream into a catalytic methanation reaction chamber where the hydrogen and carbon dioxide react to produce methane, thereby producing a natural gas having a diminished content of carbon dioxide.

2. The process of claim 1, further comprising the steps of:

diverting a second side stream of natural gas from the natural gas stream;

combusting the diverted second side stream of natural gas to generate heat; and, supplying the heat to the hydrogen separator reaction chamber and/or the methanation reaction chamber.

3. The process of claim further comprising the steps of:

diverting a second side stream of natural gas from the natural gas stream;

combusting the diverted second side stream of natural gas to generate heat; and, applying the heat to regenerate catalyst.

* * * * *

UNITED STATES PATENT AND TRADEMARK OFFICE

CERTIFICATE OF CORRECTION

PATENT NO. : 6,419,888 B1
DATED : July 16, 2002
INVENTOR(S) : Daniel Wyckoff

It is certified that error appears in the above-identified patent and that said Letters Patent is hereby corrected as shown below:

Title page,
Item [57], ABSTRACT,
Line 9, replace the word “steam” with the word -- stream. --

Column 10,
Line 29, insert -- 1 -- after the word “claim” and before the word “further.”

Signed and Sealed this

Sixth Day of May, 2003

JAMES E. ROGAN
*Director of the United States Patent and Trademark Office*